US007246792B2

(12) United States Patent
Leone et al.

(10) Patent No.: US 7,246,792 B2
(45) **Date of Patent: *Jul. 24, 2007**

(54) ORNAMENTAL FENCE INSERT

(75) Inventors: Nicola Leone, Hornby (CA); Joseph Isopo, Woodbridge (CA)

(73) Assignee: Iron Eagle Industries Inc., Mississauga, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/815,785

(22) Filed: Apr. 2, 2004

(65) Prior Publication Data

US 2005/0218389 A1 Oct. 6, 2005

(51) Int. Cl.
*E04H 17/00* (2006.01)

(52) U.S. Cl. ..... 256/22; 256/1; 256/21; 256/65.11

(58) Field of Classification Search ..... 256/1, 256/19, 21, 22, 65.11; D25/38
See application file for complete search history.

(56) References Cited

U.S. PATENT DOCUMENTS

| | | | | | |
|---|---|---|---|---|---|
| 7,774 | A * | 11/1850 | Krauser | 256/21 |
| 8,149 | A * | 6/1851 | Crowell | 256/21 |
| 386,124 | A * | 7/1888 | Hainsworth | 256/21 |
| 712,259 | A * | 10/1902 | Carr | 256/21 |
| 1,664,080 | A * | 3/1928 | Mapson | 256/22 |
| 2,823,014 | A * | 2/1958 | Schrage | 256/21 |
| D195,033 | S * | 4/1963 | Pierce | D25/38 |
| 4,805,879 | A * | 2/1989 | Spera | 256/22 |
| 5,224,256 | A | 7/1993 | Haglund | |
| 6,254,064 | B1 * | 7/2001 | Gibbs | 256/22 |
| D449,383 | S * | 10/2001 | Erwin | D25/38 |
| D462,452 | S * | 9/2002 | Miranda | D25/38 |
| D479,612 | S | 9/2003 | Larsen et al. | |
| 6,648,304 | B1 * | 11/2003 | Zhu | 256/22 |
| 6,802,496 | B1 * | 10/2004 | Preta | 256/65.04 |
| 6,824,123 | B2 * | 11/2004 | Larsen et al. | 256/22 |
| 6,932,350 | B1 * | 8/2005 | Husted | 277/421 |
| D518,897 | S * | 4/2006 | Walker | D25/38 |
| D519,215 | S * | 4/2006 | Walker | D25/38 |
| D522,664 | S * | 6/2006 | Leone et al. | D25/38 |
| D525,716 | S * | 7/2006 | Walker | D25/38 |
| D527,465 | S * | 8/2006 | Walker | D25/38 |

FOREIGN PATENT DOCUMENTS

| | | | |
|---|---|---|---|
| CA | 2449310 | A1 * | 5/2005 |
| DE | 1683158 | * | 3/1971 |
| DE | 29711996 | U1 * | 9/1997 |
| FR | 2853702 | A1 * | 10/2004 |

* cited by examiner

*Primary Examiner*—Daniel P. Stodola
*Assistant Examiner*—Ernesto Garcia
(74) *Attorney, Agent, or Firm*—Arne I. Fors

(57) ABSTRACT

An ornamental fence insert for a picket fence. The picket fence is of the type having two upper rails and a plurality of pickets extending through the rails to define spaces therebetween. The ornamental fence insert, having diametrically opposed projecting brackets, with each bracket having a pair of opposed sidewalls is adapted for installation in one of the spaces by straddling and engaging the pickets or the rails without the aid of welding or riveting.

8 Claims, 6 Drawing Sheets

ORNAMENTAL FENCE INSERT

BACKGROUND OF THE INVENTION (i) Field of the Invention

This invention relates to ornamental inserts, and more particularly, relates to an ornamental fence insert for a picket fence or a trellis.

(ii) Description of the Related Art

It has been known in the art to have a fence assembly including an upper rail, a lower rail, a plurality of vertical pickets and to further have a third intermediate horizontal rail positioned slightly below and parallel to the upper horizontal rail so as to define square or rectangular openings between the rails and the adjacent pickets in which ornamental rings have been inserted. The rings have generally been attached by welding, rivets or other attachment means.

U.S. Design Pat. No. D479,612 shows decorative circular inserts secured between vertical pickets.

U.S. Pat. No. 1,664,080 for an Ornamental Stair Rail Structure has annular members interposed between vertical bars and pairs of rails. Horizontal connectors for connecting adjacent annular members to intermediate vertical bars are shown.

U.S. Pat. No. 5,224,256 for a Method of Assembly of Tubular Metallic Fences shows two rows of hoops positioned between pickets, one row being positioned between but spaced apart from a pair of railings and the other row of hoops independent of railings. Joints to hold together tubular parts of the fence, including the hoops and pickets, are formed by applying transverse forces to deform the working surfaces of parts into receiving openings of adjoining parts.

U.S. Pat. No. 6,254,064 for an Ornamental Ring for Fence has an ornamental ring attached to an upper horizontal rail by an upper tang and to a lower horizontal rail by a lower ear. Each of upper tang and lower ear has a hole through which a rod runs.

It would be beneficial to reduce the time and expense inherent in prior art means for fixing ornamental fence inserts in place.

It is according to a principal object of the present invention to provide an ornamental insert installable in a picket fence or trellis without the use of additional attachment means.

It is another object of the present invention to provide an ornamental insert for a metal picket fence or a trellis which is simple in construction and inexpensive to manufacture and install.

It is a further object to provide an ornamental fence or trellis which can be easily and quickly assembled by a workman without the need of special tools or equipment.

SUMMARY OF THE INVENTION

In its broad aspect, the ornamental fence insert of the invention comprises a body with a perimeter, with brackets projecting from the perimeter on diametrically opposite sides of the body, each bracket having a pair of opposed sidewalls adapted for straddling and engaging vertical pickets of a fence or parallel rails of a trellis.

In accordance to a further aspect of the invention, the ornamental fence insert has an upwardly facing abutment surface and a downwardly facing abutment surface formed diametrically opposite on the perimeter of the body, with the brackets projecting outwardly and horizontally from the perimeter of the body, each bracket having a pair of opposed sidewalls adapted for straddling and engaging the vertical pickets of a fence.

In accordance with a still further aspect of the invention, there is provided an ornamental insert for a metal picket fence comprising a substantially horizontally extending top rail having a bottom surface, a substantially horizontally extending intermediate rail having a top surface and being spaced below the top rail, and a plurality of equi-spaced substantially vertical pickets extending through the intermediate and top rails to define rectangular spaces with the rails. The intermediate rail would normally be intermediate to a top rail and a bottom rail, but it is possible for there to be more than one rail below the intermediate, or none. The ornamental fence is located in one of the rectangular spaces having brackets engaging the vertical pickets, the upwardly facing flat abutment surface abutting the top rail bottom surface and the downwardly facing flat abutment surface abutting the intermediate rail top surface to fixedly engage the fence insert with the metal picket fence.

A further aspect of the invention provided includes the opposed sidewalls being joined by a web to define a u-shaped recess.

In accordance with a further aspect of the invention, there is provided an ornamental fence insert for a tubular metal picket fence in which each of the sidewalls overlaps a surface of one picket, in the direction of the horizontally extending direction of the rails, by a distance less that one half of the dimension of the picket in the direction of the rails, whereby the sidewalls of adjacent fence inserts do not impinge.

In accordance with a further aspect of the invention, there is provided the use of the ornamental fence insert in a metal picket fence having a plurality of equi-spaced vertical pickets and parallel rails secured to the pickets defining a square opening with a pair of adjacent pickets.

In accordance with an further aspect of the invention, there is provided a trellis comprising a pair of parallel, spaced-apart rails and a plurality of equi-spaced transverse pickets extending between the rails to define rectangular spaces, preferably square spaces, with the rails, and the ornamental inserts of the invention inserted in said spaces. The ornamental insert comprises a body with a perimeter and brackets projecting outwardly from the perimeter of the body on diametrically opposite sides of the body, each bracket having a pair of opposed sidewalls adapted for straddling and engaging the transverse pickets. It is also in accordance with the invention for the trellis to have diagonal rails and pickets.

Further aspects of the invention provided include an ornamental insert having a body which is substantially circular, astroidal, elliptical, diamond-shaped or cross-shaped.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
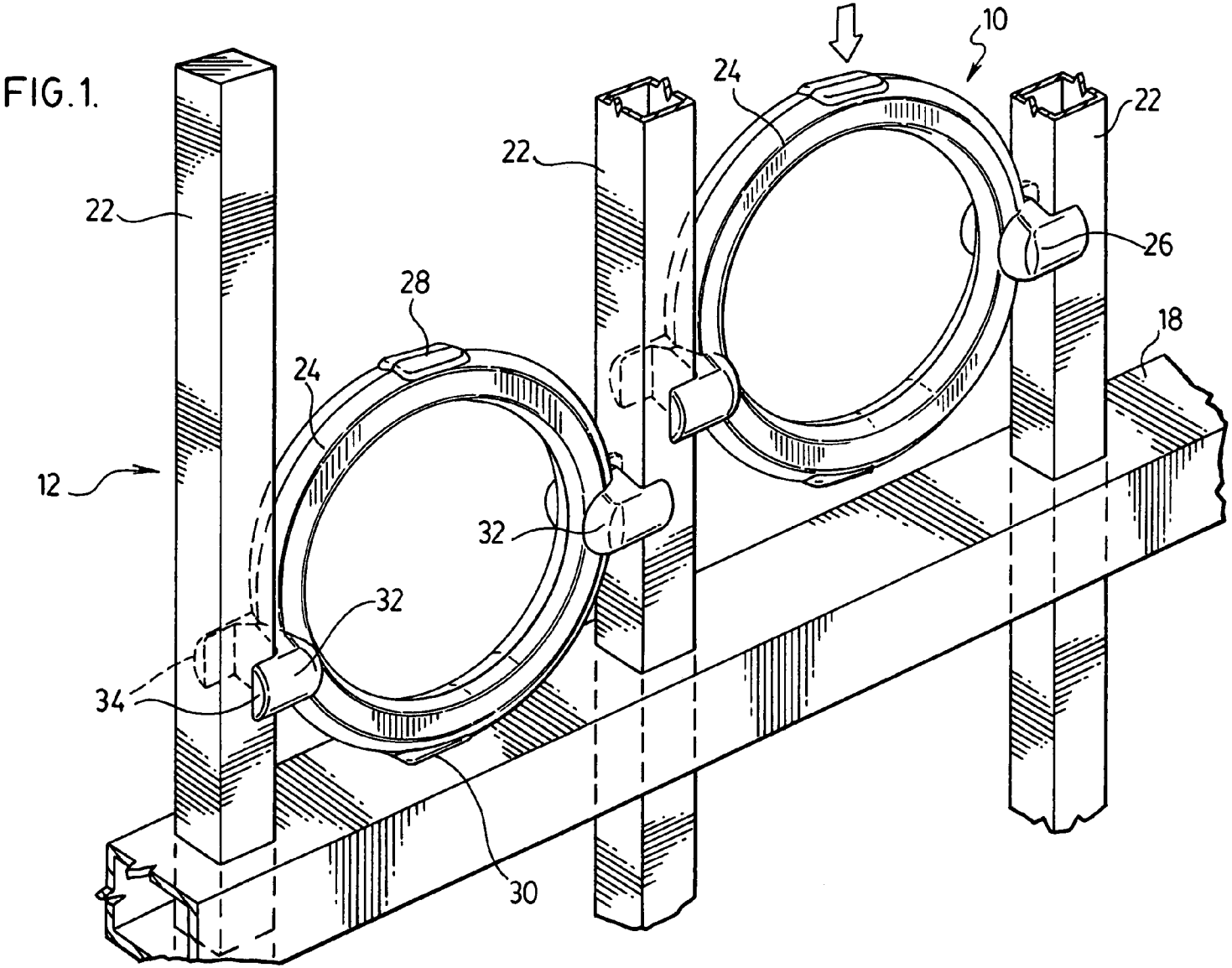
FIG. 1 is a perspective view of a picket fence embodying the present invention before installation of a top rail, showing one ornamental insert seated on the intermediate rail and one insert being installed.
Figure 2:
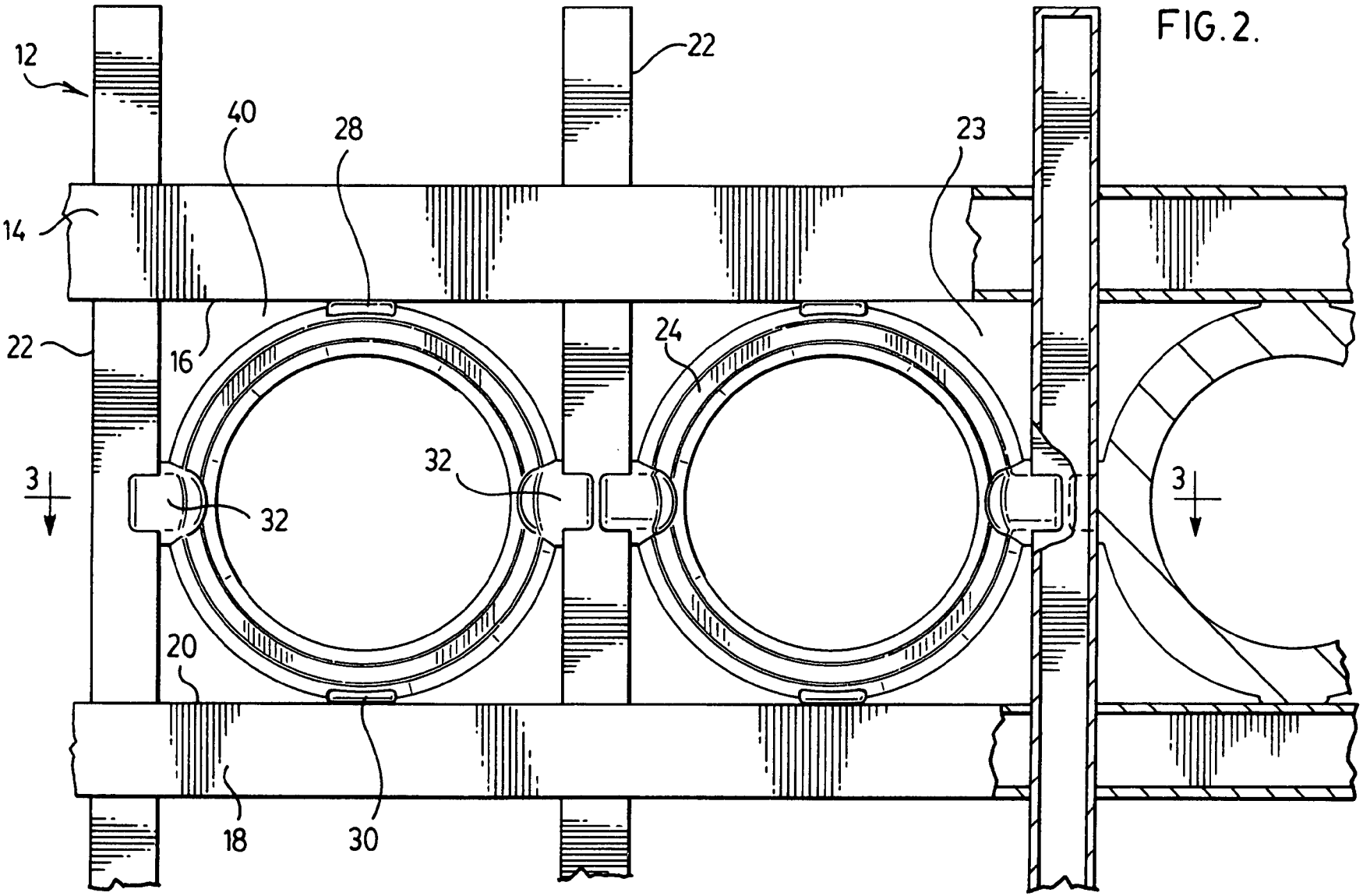
FIG. 2 is a side elevational view, partially cut away, of the picket fence showing the inserts and top rail installed.
Figure 3:
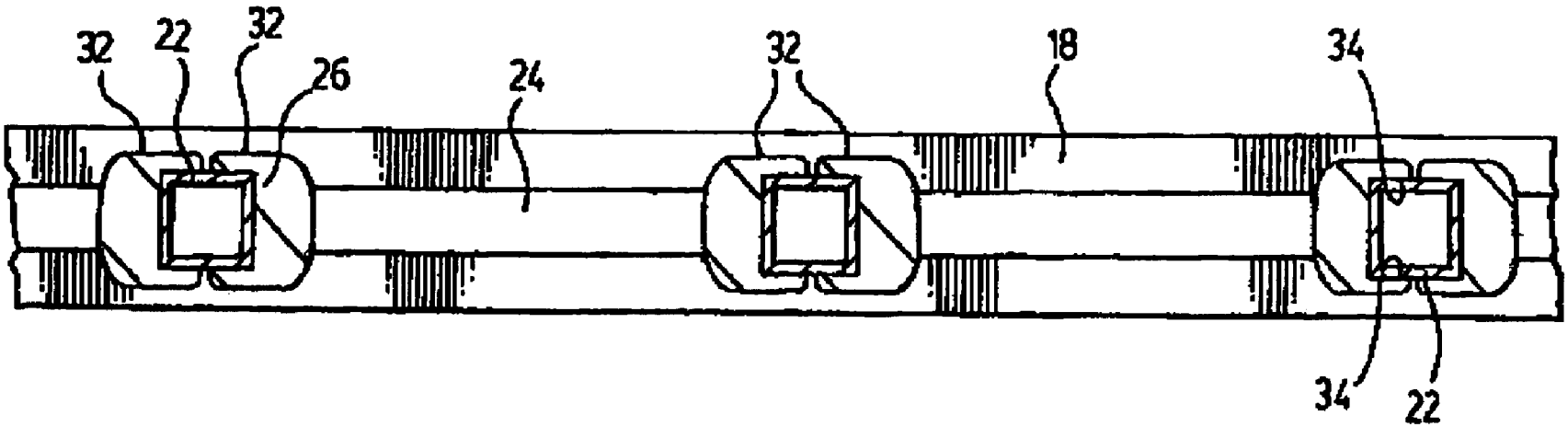
FIG. 3 is a top sectional view along line 3-3 of FIG. 2.

With reference first to FIGS. 1 to 3, the present invention is for an ornamental insert 10 for a metal picket fence 12, the picket fence 12 having a plurality of equi-spaced vertical pickets 22 and upper and lower spaced-apart parallel rails 14, 18 secured to the pickets 22, defining an opening 23 with each pair of adjacent pickets. The opening can be a rectangular space 40, e.g. square, or it can be a non-rectangular quadrilateral, depending on the angles of the rails 14, 18 relative to the pickets 22. The rails could be non-horizontal for a variety of reasons, such as the fence being constructed on uneven ground.

The ornamental fence insert 10 comprises a body 24, with brackets 32 projecting from diametrically opposite sides of the perimeter of the body 24, each bracket 32 having a pair of opposed, spaced-apart sidewalls 34 adapted for straddling and engaging the vertical pickets 22 or the parallel rails 14, 18. The invention as generally defined could also find application in other constructions, such as stairway railing and fence combinations, and trellises.

In the preferred embodiment of an ornamental fence insert 10 for a metal picket fence 12, as shown in FIGS. 1 to 3, the picket fence 12 comprises a substantially horizontally extending top rail 14 having a bottom surface 16, a substantially horizontally extending parallel intermediate rail 18 having a top surface 20 spaced below the top rail 14, and a plurality of equispaced substantially vertical pickets 22 extending through the intermediate and top rails to define square spaces 40 with the rails. The ornamental fence insert 10 comprises a body 24, having abutment surfaces formed on a perimeter of the body, in particular an upwardly facing flat abutment surface 28 and a downwardly facing flat abutment surface 30 equispaced from the brackets about the perimeter. Brackets 32 project outwardly and horizontally from the perimeter of the body on diametrically opposite sides of the body 24, each bracket 32 having a pair of opposed sidewalls 34 adapted for straddling and engaging vertical pickets 22.

In the preferred embodiment of the invention, the ornamental fence insert 10 is located in one of the rectangular spaces 40, having lateral brackets 32 engaging vertical pickets 22, and the upwardly facing flat abutment surface 28 abutting the top rail bottom surface 16 and the downwardly facing flat abutment surface 30 abutting the intermediate rail top surface 20 to fixedly engage the fence insert 10 with the metal picket fence 12.

Figure 4:
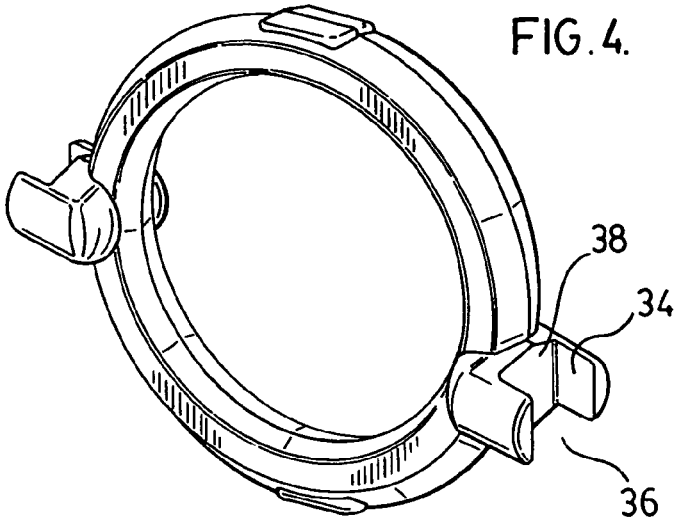
FIG. 4 is a perspective view of a circular shaped embodiment of the ornamental insert.
Figure 5:
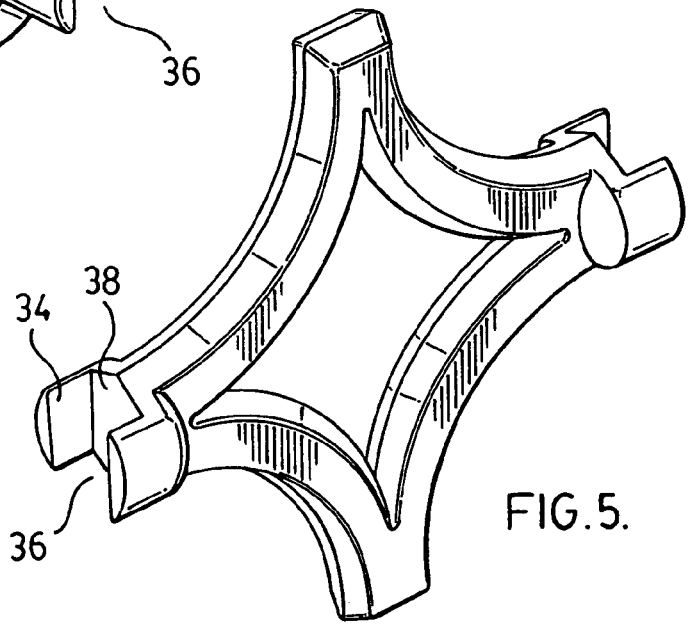
FIG. 5 is a perspective view of an astroidal shaped embodiment of the ornamental insert.
Figure 6:
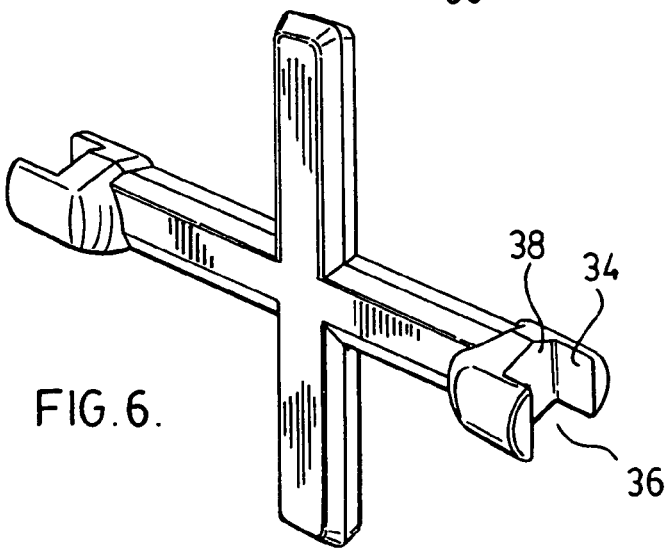
FIG. 6 is a perspective view of a cross-shaped embodiment of the ornamental insert.
Figure 7:
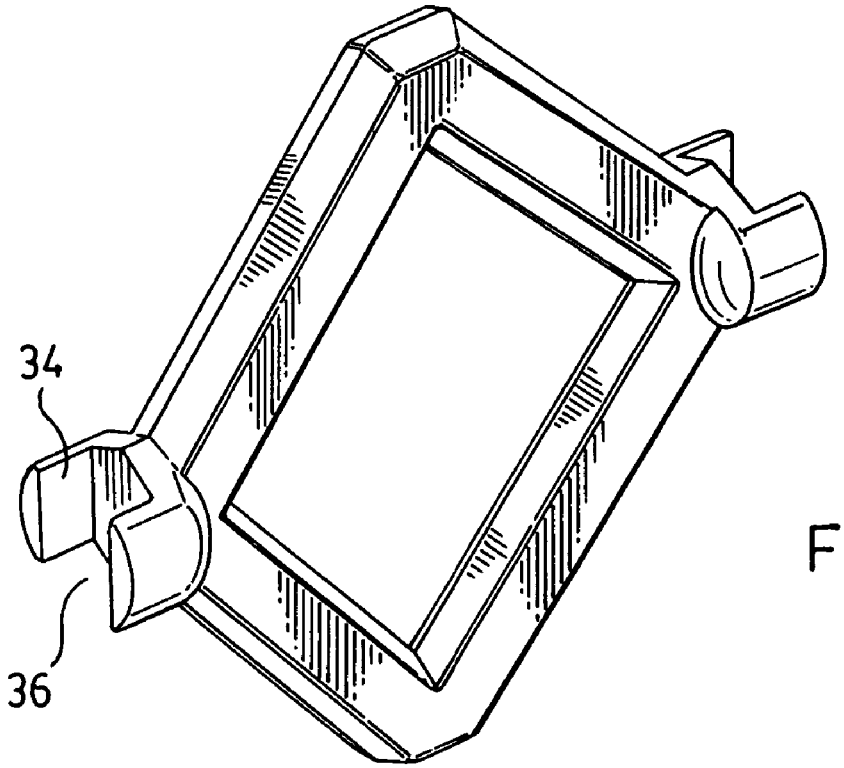
FIG. 7 is a perspective view of a diamond-shaped embodiment of the ornamental insert.
Figure 8:
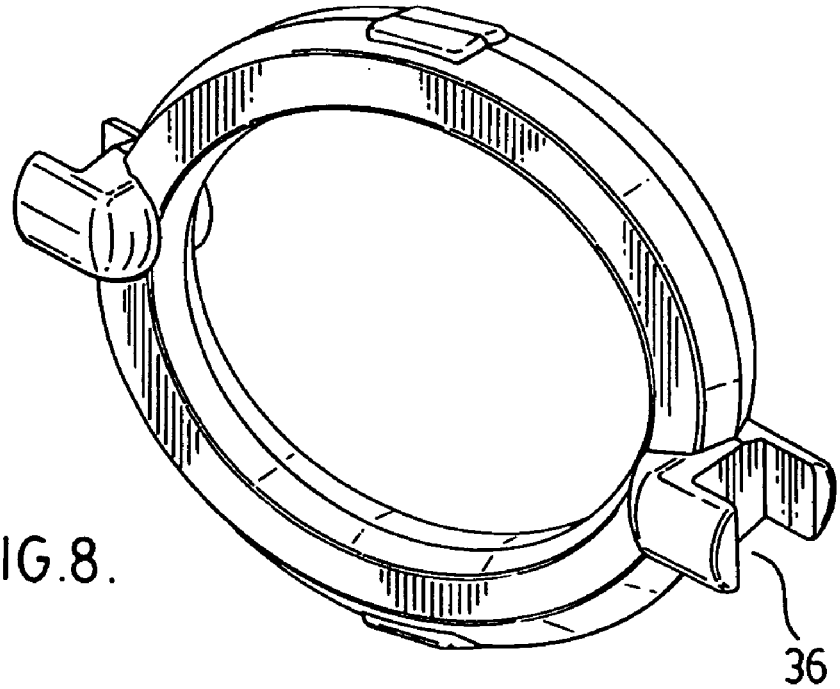
FIG. 8 is a perspective view of an elliptical shaped embodiment of the ornamental insert.

Opposed sidewalls 34 of brackets 32 are joined by a web 38, preferably being joined by web 38 to define a U-shaped recess 36, as shown most clearly in FIG. 4. Each of the sidewalls 34 overlaps a surface of one picket 22, in the direction of the horizontally extending direction of the rails 14,18, by a distance less that one half of the dimension of the picket 22 in the direction of the rails 14, 18, whereby the sidewalls 34 of adjacent fence inserts 10 do not impinge.

Ornamental fence insert 10 can have a body 24 which is substantially circular, elliptical, astroidal, diamond-shaped or cross-shaped, as shown in FIGS. 4 to 8.

Figure 9:
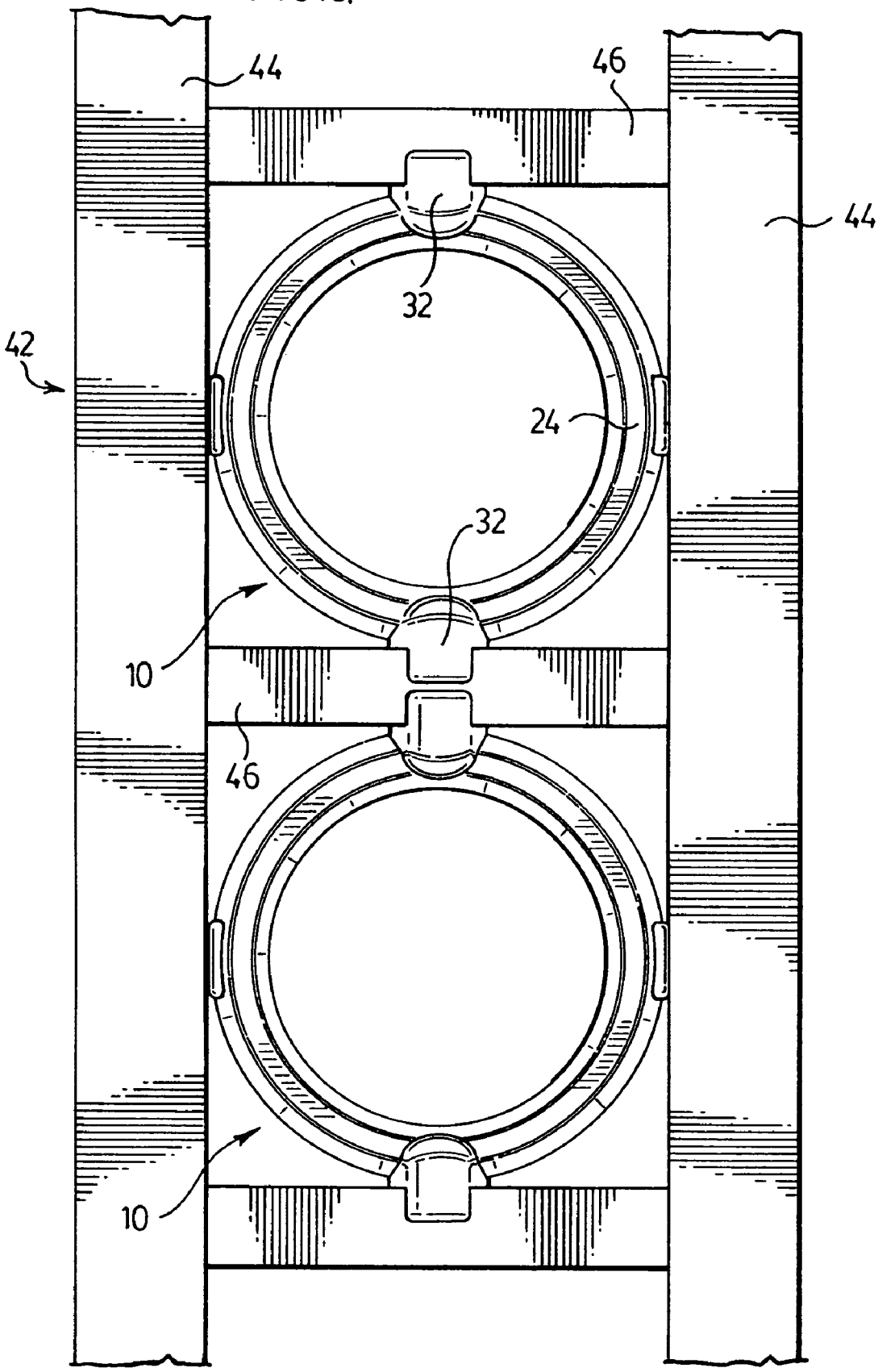
FIG. 9 is a perspective view of a section of a trellis incorporating an embodiment of the ornamental insert.

With reference to FIG. 9, another embodiment of the invention is for a trellis 42 comprising a pair of parallel, spaced-apart rails 44 and a plurality of equispaced transverse pickets 46 extending between the rails to define rectangular spaces, preferably square spaces, with the rails, and the ornamental insert 10 of the invention inserted in said spaces. The ornamental insert 10 comprises a body 24 with a perimeter and brackets 32 projecting outwardly from the perimeter of the body on diametrically opposite sides of the body, each bracket 32 having a pair of opposed sidewalls 34 adapted for straddling and engaging the transverse pickets 46, or rails 44.

The invention can be employed in other embodiments, such as ornamental insert 10 having different shaped bodies such as shown in FIGS. 4 to 8.

The above-described embodiments of the invention are intended to be examples of the present invention and alterations and modifications may be affected thereto by those of skill in the art without departing from the scope and purview of the invention which is defined by the claims appended hereto.

The invention claimed is:

1. A picket fence comprising:

a substantially horizontally extending upper rail having a bottom surface, a substantially horizontally extending lower rail having a top surface and being spaced below and parallel to said upper rail, and a plurality of spaced substantially vertical pickets extending through said lower and upper rails to define rectangular spaces with said rails, an ornamental insert for said rectangular spaces, said ornamental fence insert comprising a body having a perimeter, an upwardly facing flat abutment surface and a downwardly facing flat abutment surface formed on the perimeter of said body in abutment with the bottom surface of the upper rail and the top surface of the lower rail, respectively, and brackets projecting outwardly and horizontally from the perimeter of said body, each bracket having a pair of opposed sidewalls defining a u-shape for straddling and engaging said vertical pickets.

2. The picket fence as claimed in claim 1 in which said opposed sidewalls are joined by a web.

3. The picket fence as claimed in claim 1 in which each of said opposed sidewalls overlaps a surface of one picket, in the direction of the horizontally extending direction of said rails, by a distance less that one half of the dimension of said picket in said direction, whereby sidewalls of adjacent fence inserts do not impinge.

4. A picket fence as claimed in claim 1, in which the spaces are square and in which the ornamental insert is selected form the group consisting of circular-shaped, astroidal-shaped, diamond-shaped and cross-shaped.

5. The picket fence as claimed in claim 4 in which said insert is metal.

6. The picket fence as claimed in claim 1 in which said insert and said picket fence are metal.

7. The picket fence as claimed in claim 1 in which said insert is elliptical shaped.

8. The picket fence as claimed in claim 7 in which said insert is metal.

* * * * *